United States Patent [19]

Whaley et al.

[11] 4,188,023

[45] Feb. 12, 1980

[54] CLAMPING DEVICE

[75] Inventors: Kent Whaley, R.R. 1, Box 6A, Wheaton, Minn. 56296; Joseph Reinart, Browns Valley, Minn.

[73] Assignee: Kent Whaley, Wheaton, Minn.

[21] Appl. No.: 964,649

[22] Filed: Nov. 29, 1978

[51] Int. Cl.[2] ..... B34Q 3/02; B25B 13/16

[52] U.S. Cl. ..... 269/228; 81/356

[58] Field of Search ..... 269/208, 228; 81/356, 81/128, 129

[56] References Cited

U.S. PATENT DOCUMENTS

| | | | |
|---|---|---|---|
| 2,691,911 | 10/1954 | Gren | 81/356 |
| 2,729,127 | 1/1956 | Watanabe | 81/356 |
| 3,220,691 | 11/1965 | Dudley | 269/208 |
| 3,578,307 | 5/1971 | Lock | 269/228 X |

*Primary Examiner*—Robert C. Watson

*Attorney, Agent, or Firm*—Watson, Cole, Grindle & Watson

[57] ABSTRACT

Disclosed is a clamping device having a locking type mechanism which is particularly adaptable for use by well drillers, well repairmen and pump installers in securely holding pipe. The device comprises a base member having a bore and having an attached jaw, a sliding member partially located within the bore of the base member, a jaw attached to the portion of the sliding member outside the bore of the base member. The jaw on the sliding member is adapted to cooperate with the jaw attached to the base member to clamp about an object. The device further includes a clamping mechanism including a lever pivotably attached to the base member at a point on the arm spaced from the end of the lever, and a connecting linkage pivotably attached near the end of the lever and to the slidable member. In operation, upon rotation of the free end of the lever towards the base member, the jaw of the slidable member is caused to move towards the jaw of the base member and, upon sufficient rotation of the lever toward the base member, the longitudinal axis of the connecting linkage passes through the axis of the pivot connecting the base member and the lever so as to lock the clamping mechanism.

9 Claims, 3 Drawing Figures

CLAMPING DEVICE

BACKGROUND OF THE INVENTION

The present invention relates generally to clamping devices and more specifically, to clamping devices having a locking type mechanism which are particularly adapted for use by well drillers, well repairmen and pump installers in securely holding pipes when servicing wells or installing pumps.

A wide variety of clamping devices having locking type mechanisms are known in the art. For example, U.S. Pat. No. 2,379,107 to Scheck discloses a clamp wrench having a stationary jaw fixed to the shank, a movable jaw slidably mounted on the shank, and means for moving the movable jaw comprising a lever pivotly attached to the movable jaw, a toggle link, a rotatable screw for relative adjustment of the movable jaw and a movable block on the shank attached to the toggle link and the screw. In U.S. Pat. No. 2,651,959 to Harrington, disclosed in a sliding jaw vise including a base having a fixed and movable jaw attached thereto, an adjustable threaded push rod attached to the movable jaw, and a link pin and lever which lock the movable jaw against a workpiece. In the vise the Harrington patent, the movable jaw is adjustable on the push rod by the provision of a series of holes and a drop pin.

Furthermore, U.S. Pat. No. 2,692,520 to Hayes discloses a toggle operated pipe holder where the toggle mechanism is adjustable by means of a threaded rod. In a toggle lever actuated sliding jaw vise as taught by U.S. Pat. No. 2,841,196 to Zazdrzyk, a movable jaw is pulled against the fixed jaw by the toggle mechanism. U.S. Pat. No. 3,152,466 to Johnson discloses a vise comprising a support having a fixed and movable jaw attached thereto, a threaded adjustment rod attached to the movable jaw, and a toggle mechanism pivotly attached to the support and to the threaded rod, the threaded rod acting as a lever for locking the toggle mechanism.

However, none of the above mentioned patents appear to disclose a clamping device which includes the combination of features of an adjustable mechanism to lock a movable jaw relative to a fixed jaw by pulling as opposed to pushing the movable jaw toward the fixed jaw by means of a structure including an inwardly moving lever which pulls the movable jaw toward the fixed jaw.

SUMMARY OF THE INVENTION

It is therefore an object of the present invention to provide a clamping device which includes a mechanism to lock a movable jaw relative to a fixed jaw so as to securely clamp an object.

Another object of the present invention is to provide a clamping device which includes a mechanism which pulls a movable jaw toward a fixed jaw by means of an inwardly moving lever arm.

Yet another object of the present invention is to provide a clamping device which is compact when in the locked or closed position and is therefore not easily accidentally unlocked.

A further feature of the present invention is to provide a clamping device which can be easily operated by one hand.

The invention, in its broader aspects, comprehends a clamping device comprising a base member having a bore and having a jaw attached thereto, a sliding member partially located within the bore of the base member, a jaw attached to the portion of the sliding member outside the bore of the base member and adapted to cooperate with the jaw attached to the base member to clamp about an object, and a clamping mechanism including a lever arm pivotably attached to the base member at a point on the lever spaced from the end of the lever, and a connecting linkage pivotably attached to the lever and to the slidable member, whereby upon rotation of the free end of the lever towards the base member, the jaw of the sliding member is caused to move towards the jaw of the base member and upon sufficient rotation of the lever toward the base member, the longitudinal axis of the connecting linkage passes through the axis of the pivot connecting the base member and the lever.

Further objects, advantages and features of the present invention will become more fully apparent from a detailed consideration of the arrangement and construction of the constituent parts of a preferred embodiment as set forth in the following specification taken together with the accompanying drawing.

DETAILED DESCRIPTION OF THE PREFERRED EMBODIMENT

Figure 1:
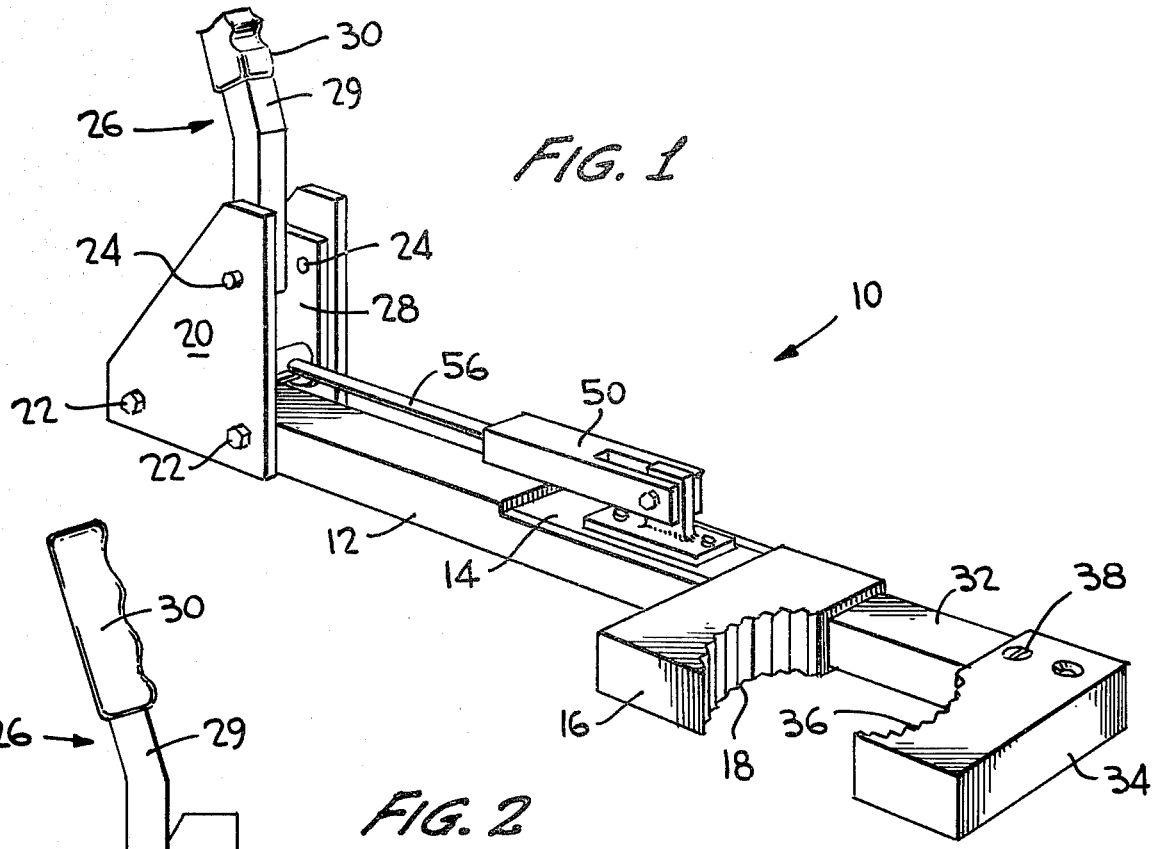
FIG. 1 is a perspective view of one embodiment of a clamping device in accordance with the present invention.
Figure 2:
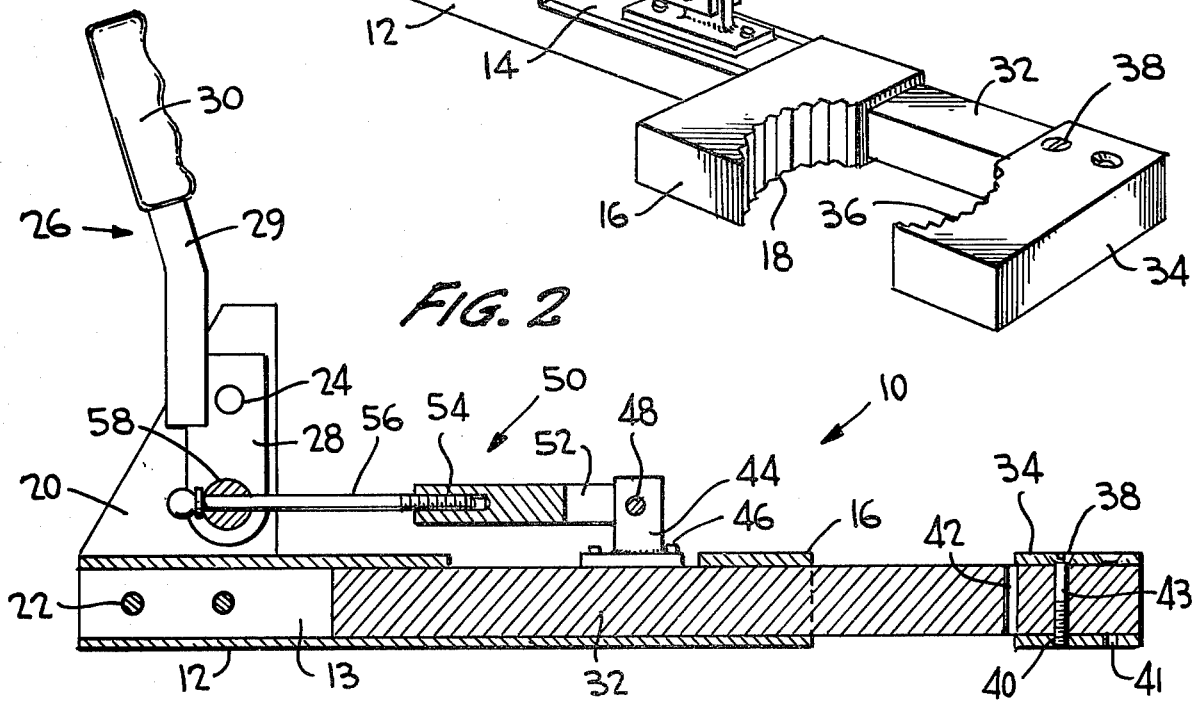
FIG. 2 is a cross-sectional view of the clamping device of FIG. 1, the device being in the open position.
Figure 3:
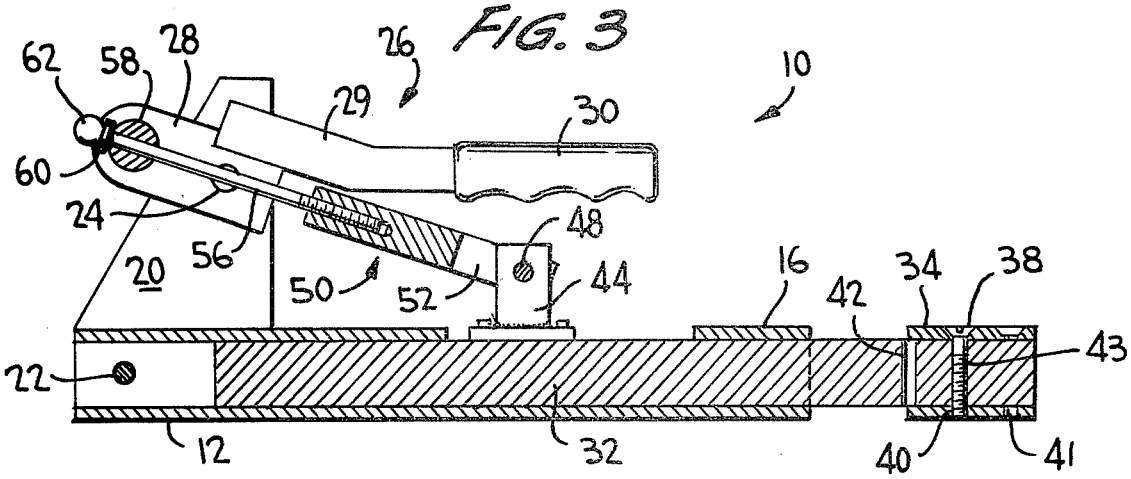
FIG. 3 is a cross-sectional view similar to that of FIG. 2, the clamping device being shown in the closed or locked position.

In FIGS. 1–3, shown in clamping device 10 in accordance with the present invention which is particularly adapted for securely clamping a length of pipe. Clamping device 10 includes base member 12 which includes bore 13 of a rectangular cross-sectional configuration. While bore 13 of base member 12 is shown as extending through the entire length of the member, alternatively the bore may extend only through a portion of the base member. Furthermore, bore 13 need not have a rectangular configuration but may be of other shapes as well. A portion of the top surface of base member 12 is cut away to provide opening 14 communicating with bore 13.

Fixedly attached to the end of base member 12 near opening 14 is jaw 16 having arcuate clamping surface 18. At the other end of base member 12 is a pair of upstanding supports 20, each support attached to the base member by bolts 22. Pivotly attached to the upper portion of each support 20 by pin 24 is lever 26 including two parallel extending leg portions 28 and lever arm 29. Lever arm 29 of lever 26 bridges the distance between leg portions 28 and its free end includes hand grip 30.

Located partially within base member 12 is sliding member 32 which is preferably a solid square bar. On the end of sliding member 32 which projects from base member 12 and jaw 34 which has an arcuate clamping surface 36 of the opposite configuration from surface 18 of fixed jaw 16.

As is best shown in FIGS. 2 and 3, jaw 34 is affixed to sliding member 32 by pin 38 extending through one of two holes 40 and 41 provided in the jaw and through one of two holes 42 and 43 in the sliding member. By appropriate placement of pin 38 in one of holes 40 and 41 and one of holes 42 and 43, the distance between movable jaw 34 and fixed jaw 16 can be varied. For example, holes 40–43 can be positioned such that when pin 38 is in hole 40 of jaw 34 and in the hole 42 of sliding member 32, device 10 can clamp a pipe of about ½ to 1 inches in diameter; when in hole 41 of the jaw and hole 43 of the sliding member, the device can clamp pipe of about 1¼ to 1½ inches in diameter, and when the pin is in hole 40 of the jaw and hole 43 of the sliding member, the device can clamp pipe of about 2 inches in diameter. Clearly, the positioning of holes 40–43 can be arranged differently to yield other size ranges. Furthermore, a greater number of holes in jaw 34 as well as in sliding member 32 can be utilized to vary the distance between the jaws.

Mechanically connecting leg portions 28 of lever 26 and sliding member 32 is a connecting linkage comprising an anchor member 44, yoke 50, rod 56 and pivot member 58. Anchor member 44 is affixed to sliding member 32 by bolts 46 such that the anchor member projects upwardly through opening 14 in base member 12. Pivotly attached to anchor member 44 by pin 48 is yoke 50 having two projecting parallel arm portions 52 on each side of the anchor member, the pin passing through each arm portion. The end of yoke 50 opposite from arm portions 52 is provided with a threaded hole 54 and threaded adjustment rod 56 engages the threads within the threaded hole of the yoke. The other end of adjustment rod 56 passes through pivot member 58, the ends of which are each amounted for rotation within leg portions 28 of lever 26. The distal end of adjustment rod 56 adjacent to pivot member 58 includes flange 60 which prevents movement of the rod through the pivot member in one axial direction and also includes enlarged portion 62 which provides a convenient gripping means for manual rotation of the rod.

In operation of clamp device 10, lever 26 is initially in the open or up position as shown in FIG. 2. An object to be clamped such as a pipe (not shown) is then inserted between the clamping surfaces 18 and 36 of jaws 16 and 34 respectively. The free end of lever arm 29 is then rotated towards base member 12 until the closed position as shown in FIG. 3 is reached. As is evident from FIGS. 2 and 3 of the drawing, rotation of lever arm 29 causes leg portions 28 of lever 26 to rotate about pin 24 which in turn creates an axial force on adjustment rod 56 and yoke 50 so as to cause sliding member 32 to move axially within base member 12 and thereby displace jaw 34 towards fixed jaw 16 and enable an object to be clamped. Once lever arm 29 rotates far enough to cause the longitudinal axis of adjustment rod 56 to pass through and to above the axis between pins 24 on supports 20 and the lever arm contacts yoke 50, jaws 16 and 34 of device 10 will then be locked about the object.

The distance between jaws 16 and 34 in the closed position can be varied within certain limits by rotation of adjustment rod 56 within yoke 50. Adjustment rod 56 also allows the clamping force provided by jaws 16 and 34 on a particular object to be varied.

Preferably all the components of device 10 set forth above except for grip 30 are of high strength materials such as steel. Clamping surfaces 18 and 36 of jaws 16 and 34 respectively may be of hardened steel so as to increase the useful life of device 10. Grip 30 preferably is a shaped polymer sleeve over the free end of lever arm 29.

In addition, while various portions of the illustrated embodiment have been shown to be separate components, it should be realized that these components could be integral. For example, base member 12, supports 20 and jaw 16 could all be a unitary, integral component. The illustrated separate components are, however, preferred for ease of fabrication and for reducing the bulkiness of the device.

As was mentioned previously, the clamp device 10 of the present invention is particularly adaptable for use by well drillers, well repairmen and pump installers in securely holding various sized pipe. Since the ratio of movement of lever arm 29 is large compared to the movement of sliding member 32 and jaw 34, device 10 can be easily operated by one hand which thereby provides a fast and efficient means for securely holding pipes when installing pumps or servicing wells. Furthermore, since lever arm 29 of device 10 is adjacent to the remaining components of the device when the device is in the closed or locked position, the lever arm is not likely to be accidently contacted so as to release the object being clamped. Thus, the device of the present invention provides a compact and secure means for clamping an object such as a pipe.

While the present invention has been described with reference to a particular embodiment thereof, it will be understood that numerous modifications may be made by those skilled in the art without actually departing from the spirit and scope of the invention as defined in the appended claims.

We claim:

1. A clamping device comprising a base member having a bore and having an attached jaw, the base member including an opening in the wall of the member communicating with the bore, a sliding member partially located within the bore of the base member, a jaw attached to the portion of the sliding member outside the bore of the base member and adapted to cooperate with the jaw attached to the base member to clamp about an object, and a clamping mechanism including a lever pivotably attached to the base member at a point on the lever spaced from the end of the lever, and a connecting linkage pivotably attached near the end of the lever and to the slidable member through the opening in the base member, whereby upon rotation of the free end of the lever towards the base member, the jaw of the slidable member is caused to move towards the jaw of the base member and upon sufficient rotation of the lever toward the base member, the longitudinal axis of the connecting linkage passes through the axis of the pivot connecting the base member and the lever.

2. A clamping device according to claim 1 wherein the connecting linkage is adjustable in length.

3. A clamping device according to claim 1 wherein the connecting linkage comprises a yoke pivotably attached to the sliding member of one end and having a threaded bore at the other end and a threaded rod pivotably attached to the lever arm at one end and engaging the threaded bore of the yoke at the other end.

4. A clamping device according to claim 1 wherein the jaw is attached to the sliding member by a pin passing through a hole in the jaw and a hole in the sliding member.

5. A clamping device according to claim 4 wherein the jaw on the sliding member includes at least two holes so that the position of the jaw on the sliding member is adjustable.

6. A clamping device according to claim 5 wherein the sliding member includes at least two holes for attachment of the jaw by the pin.

7. A clamping device according to claim 1 wherein the lever includes two parallel leg portions extending from the point at which the lever is pivotably attached to the base member, the leg portions bridged by a pivot member coupled to the rod of the connecting linkage.

8. A clamping device according to claim 1 wherein the bore in the base member and the external shape of the sliding member are both of rectangular configuration.

9. A clamping device according to claim 1 wherein the rod of the connecting linkage includes gripping means to facilitate adjustment of the rod.

* * * * *